US006090511A

United States Patent [19]

Yang et al.

[11] Patent Number: 6,090,511

[45] Date of Patent: Jul. 18, 2000

[54] MULTI-LAYERED ELECTROPHOTOGRAPHIC PHOTORECEPTORS AND METHOD FOR ENHANCING PHOTOSENSITIVITY THEREOF

[75] Inventors: Chen-Jen Yang; Kuo-Chu Yeh, both of Hsinchu, Taiwan

[73] Assignee: Sinonar Corp., Hsinchu, Taiwan

[21] Appl. No.: 09/138,211

[22] Filed: Aug. 21, 1998

[51] Int. Cl.[7] ..... G03G 5/043

[52] U.S. Cl. ..... 430/57.2; 430/133; 430/57.3

[58] Field of Search ..... 430/57.2, 57.3, 430/59.5, 133, 64, 57.8

[56] References Cited

U.S. PATENT DOCUMENTS

| | | | |
|---|---|---|---|
| 5,432,034 | 7/1995 | Nogami et al. | 430/59.2 |
| 5,567,559 | 10/1996 | Yang et al. | 430/59.5 |
| 5,576,131 | 11/1996 | Takai et al. | 430/59.3 |
| 5,641,599 | 6/1997 | Markovics et al. | 430/64 |
| 5,849,445 | 12/1998 | Visser et al. | 430/57.3 |

*Primary Examiner*—John Goodrow
*Attorney, Agent, or Firm*—W. Wayne Liauh

[57] ABSTRACT

An improved photoreceptor is disclosed which contains a multi-layered charge generation layer formed on a substrate and a charge transport layer formed on the multi-layered charge generation layer. The multi-layered charge generation member is formed by sequentially forming a plurality of charge generation sub-layers first on the substrate then on the charge generation sub-layer that was already formed, so as to create at least one interface between the charge generation layers. The charge generation materials in the plurality of charge generation layers must satisfy the following relationship:

$$(IP)_{CGL1} \geqq (IP)_{CGL2} \geqq (IP)_{CGL3} \ldots \geqq (IP)_{CGLn}$$

wherein: $(IP)_{CGLi}$, i=1, 2, . . . , n, represents an ionization potential of the charge generation material in charge generation layer i; and (b) a lower value of i indicating closer proximity to the substrate, and a greater value i indicates further away from the substrate. Preferably, the charge generation materials used in the respective sub-layers have the same or at least very similar chemical structure, though their crystalline structure or crystallinity may differ, so as to create a non-conventional interface between the charge generation sub-layers and thus eliminate the problems, such as high dark decay ratio, experienced with conventional between-layer interfaces. This process so disclosed also allows electrically conductive or other desired powders to be introduced into only a bottom portion of the charge generation layer, without the need to create an addition layer beyond the charge generation layer.

32 Claims, 2 Drawing Sheets

MULTI-LAYERED ELECTROPHOTOGRAPHIC PHOTORECEPTORS AND METHOD FOR ENHANCING PHOTOSENSITIVITY THEREOF

FIELD OF THE INVENTION

The present invention relates to improved electrophotographic photoreceptors which can be advantageously utilized in laser printers, copiers, and facsimile machines. More specifically, the present invention relates to a novel configuration of function-separated electrophotographic photoreceptors in which the photosensitivity is enhanced relative to the conventional function-separated photoreceptors by the incorporation of a novelly configured charge-generation layer in the formulation.

BACKGROUND OF THE INVENTION

Electrophotographic photoreceptor is the key component contributing to the image formation in laser printers, copiers, and facsimile machines. In the electrophotographic printing process, image formation is accomplished by a sequence of related steps including: charging, exposure, developing, transfer, fixing, and erasure. All these steps are achieved by cooperative interactions among respective components that are centered around the electrophotographic photoreceptor. A photoreceptor exhibiting facile photoelectric response is extremely desirable for achieving good print quality. Recent developments in electrophotographic printing technology have allowed print resolutions of 600 dpi (dots per inch), and even 1200 dpi in some more advanced laser printers. The enhanced resolution is achieved via a laser modulation technique by modifying the length and amplitude of laser pulses. The associated imaging components in the print cartridge are required to be improved accordingly to match the fine resolution provided by the improved laser component. Toners with sufficiently reduced particle size have also been developed to generate very fine resolutions for printed images. In the delicate process of electrophotography, the photoreceptor receives latent images imparted by the laser beam which, thereafter, attracts toner particles and then transfers the attracted toner to a transfer medium such as paper or transparency. Therefore, photoreceptors exhibiting high photosensitivity and other desirable photoelectric properties are of paramount importance in order to achieve high resolution printing quality.

At the present time, most electrophotographic photoreceptors are made of organic electro-active materials due to the many advantages over inorganic materials in such areas as manufacturing cost, flexibility in structure configuration, non-toxicity, etc. In organic electrophotographic photoreceptors, a function-separated format is commonly utilized to provide photoreceptors with the abilities to both generate and transport charge carriers efficiently. The function-separated format comprising a charge transport layer on top of a charge generation layer not only facilitates the generation of free charge-carriers but also allows a wide variety of design options to be selected for choosing the optimal abrasion-resistant binder resin to be used in preparing the charge transport layer.

In the fabrication of photoreceptors with high photosensitivity for the use in high-resolution printers, the following design criteria have been developed:

(1) selecting charge generation materials with high charge generation efficiency;

(2) selecting charge transport materials with expedient charge transport mobility; and (3) obtaining a good match between charge generation and charge transport materials to achieve negligible electric resistance at the interface formed therebetween.

Considerable research efforts have been focused on finding organic photoactive materials which can exhibit efficient charge generation upon exposure to light, so that they can be used as a charge generation material for use in electrophotographic photoreceptors. Typically, the charge generation materials for use in commercial applications must exhibit photosensitivity when exposing to irradiation between 750~850 nm in the case of laser printers using the semiconductor diode laser as the light source. Some well-known near-infrared sensitive organic materials include squarulenes, phthalocyanines and perylenes. Among them titanyl phthalocyanine is especially of interest due to its very high efficiency of charge generation. It has been shown in numerous prior art teachings that the charge generation efficiency of titanyl phthalocyanine (TiOPc) is very high and which can strongly depend on the crystal structure of the material. It was shown in U.S. Pat. No. 4, 898, 799 that highly sensitive Y-TiOPc can be obtained by the treatment of sulfuric acid and chlorine-containing solvents on the material. Other teachings such as U.S. Pat. Nos. 5,132,197 and 5,432,278 have shown the treatment of the water paste of the material with n-butyl ether can result in a high-sensitivity crystal form. A different technique employing the complexation reaction using ammonia gas as the crystal transformation medium was disclosed in U.S. Pat. No. 5,567,559 to obtain the highly sensitive titanyl phthalocyanine.

Well-known charge transport materials include organic molecules containing hydrazone, oxazole, pyrazoline, and triarylamine. Triarylamine molecules are the group of materials exhibiting very high hole drift mobility and receive much attention toward the aim of fabrication of high-sensitivity photoreceptors. The teachings of U.S. Pat. Nos. 4,081,274, 4,145,116 and 4,336,158 disclosed certain electroactive molecules which contain triarylamine moiety in the structure, can exhibit a very high hole mobility and result in high photosensitivity. More recently disclosed teachings such as U.S. Pat. Nos. 5,445,909 and 5,494,766 also disclosed high-mobility hole transport molecules that can also be categorized as triarylamine molecules.

However, these two approaches taught by the above-mentioned teachings are subject to limitation on the photosensitivity due to the limited extent of charge injection into the charge transport layer. In the two-layered configuration disclosed in U.S. Pat. Nos. 4,265,990, 4,233,384 and 4,306, 008, it was believed that the two electrically operative layers including a charge generation layer and a charge transport layer are subject to an interface barrier for charge injection and the photosensitivity of the as-prepared photosensitive member is limited.

U.S. Pat. No. 5,476,740 disclosed a two-layered configuration in which the distinct interface between the charge generation layer and the charge transport layer is intentionally eliminated. The art utilized a technique to coat a charge transport layer on an undried charge generation layer to form a photosensitive member with a "merged" charge transport layer. It was claimed that by disrupting the well-defined interface, the charge generation material and the charge transporting material can be mixed more efficiently and therefore the otherwise formed interfacial barrier to the charge carrier injection is removed. However, the '740 patent has some inherent drawbacks when it is utilized in large scale production operations. In mass-fabrication processes, the undried charge generation material can diffuse into the charge transport layer and cause difficulties in operation.

Other prior art teachings such as U.S. Pat. Nos. 4,518,669, 4,579,801 and 5,391,448 disclosed a configuration which utilizes electrically conductive particles in the intermediate subbing layer, so as to obtain a smoothened inner layer underlying the charge generation layer and the charge transport layer. However, these prior art teachings were only aimed to suppress reflection of light from the substrate and to improve the electric grounding properties. They did not affect or improve the photosensitivity of the photosensitive member.

SUMMARY OF THE INVENTION

The primary object of the present invention is to develop an photoreceptor with enhanced photosensitivity. More specifically, the prime object of the present invention is to develop an improved photoreceptor with enhanced photosensitivity as evidenced by reduced half-exposure energy, without adversely affecting, or even improving, other photoelectrical properties, such as dark decay potential and residual potential.

In the present invention, it was found that, contrary to the conventional belief, an interface created between two charge generation layers can actually improve the photosensitivity of a photoreceptor. In other words, the inventors of the present invention have discovered that, by substituting the conventional charge generation layer, which has a single-layered structure, with a multi-layered charge generation member, which contains at least two charge generation layers with an interface therebetween, the number of charge carriers injected to the charge transport layer can be substantially increased.

A typical example of the photosensitive member incorporating a dual charge generation layer is shown in FIG. 1(A). The key element of this embodiment of the present invention is that the charge generation member is caused to have a dual-charge-generation-layer so as to create an interface therebetween, other configurations of the photosensitive members can be fabricated as desired, as shown in FIGS. 1(B) through 1(H), respectively. Since the key of the improvement is to create an interface between the charge generation layers, the configurations shown in FIGS. 1(A) through 1(H) can be extended to include those embodiments with more than two charge generation layers, thus more than one charge generation interface, as shown in FIG. 1(I).

As discussed above, the primary object of the present invention is to fabricate photosensitive members in which the configuration for fabrication is formed in a way that results in an enhanced photosensitivity relative to the conventional configuration. After many years of research on this subject, the inventors discovered that a substantial portion of the incident photons are not utilized for charge generation purposes in a electrophotographic photoreceptor formulated with the conventional configuration. The maximum charge generation efficiency, which has been defined as the ratio of the number of charge carriers generated relative to the number of incident photons, was therefore limited. Attempts to increase the thickness of the charge generation layer or to increase the concentration of charge generation material were found to result in an unsubstantial increase in photosensitivity but at the expense of increased charge retention capability.

Through intensive research efforts, the inventors have found that the creating of an interface by the addition of an extra charge generation layer can synergistically increase charge generation efficiency and improve the extent of charge injection into the charge transport layer to provide high-sensitivity photosensitive members. As indicated in the schematic representations shown in FIGS. 1(A) through 1(H), the additional charge generation layer is laid under the conventional charge generation layer and forms electrically connected layers in series with respect to the conventional charge generation layer and charge transport layer. The unexpected result obtained in the present invention indicates that charge generation molecules seem to become more active near the interface, or that there are more active charge generation molecules near the interface-thus the creation of an interface as disclosed in the present invention results in a substantial increase in photosensitivity compared to the conventional single-layered configurations. However, there may be other explanations. Another explanation of the function of the additive charge generation in the two charge generation layers is shown schematically in FIG. 2. Designated as CGL1 and CGL2, these two charge generation layers have their respective charge generation capabilities and add up the generated charge carriers to inject into the charge transport layer.

In the present invention, the charge generation materials of the first and the second charge generation layers are designed to satisfy the following relationship in their ionization characteristics:

$$(\mathrm{IP})_{CGL1} \geqq (\mathrm{IP})_{CGL2}$$

where $(\mathrm{IP})_{CGL1}$ and $(\mathrm{IP})_{CGL2}$ are the ionization potentials of the charge generation material in the first and the second charge generation layers, respectively. The photogenerated charge in CGL 1 appeared to be transported through CGL2 and combined with the photogenerated charge in CGL2 to inject into the charge transport layer. Similarly, an enlarged configuration consisting of more than two charge generation layers can be implemented according to the following potential characteristics to boost charge generation efficiency:

$$(\mathrm{IP})_{CGL1} \geqq (\mathrm{IP})_{CGL2} \geqq (\mathrm{IP})_{CGL3} \cdots \geqq (\mathrm{IP})_{CGLn}$$

By virtue of this charge-generation-in-series format, the photoreceptors were found to exhibit significantly enhanced photosensitivity compared to the conventional configuration consisting of only one charge generation layer.

Another important purpose of the present invention is that the photoreceptor so fabricated will also exhibit minimal potential attenuation in the dark while having improved photosensitivity. It was found that, by incorporating an additional charge generation layer, the photoreceptor tends to show reduced electric resistance and therefore resulting in high potential drop in the dark. This undesirable phenomenon is circumvented in the present invention by selecting an appropriate binder resin capable of forming strong interactions with charge generation materials, by decreasing the concentration of charge generation materials in the in the first charge generating layer CGL 1, or by increasing the thickness thereof. An alcohol-soluble resin consisting of a random copolyamide backbone structure is selected as the binder for CGL1. As a result of the optimal combination of the charge generation materials and the binder resin, and the judicious choice of the concentration and the thickness in CGL1 and CGL2, respectively, the photoreceptors of the present invention show at least equal, if not superior, charge retention capabilities and minimal dark decay compared to the conventional photoreceptors.

In the formulations disclosed in this invention, the concentration of the charge generation materials in CGL1 is low enough to avoid the undesirable increase of potential decay in the dark. In the meantime, the thickness of CGL1 is large enough, relative to other charge generation layer or layers, to result in the complete absorption of incident light beam. The selection of the binder resin in CGL1 is also a key parameter to result in closely associated interactions between the binder and the charge generation materials, and to afford the desirable large thickness.

The photoreceptor disclosed in the present invention also exhibits minimal residual potential even though it may incorporate a relatively thick underlying charge generation layer to enhance the photosensitivity. It has taken many years of dedicated research efforts by the inventors on this subject to discover that most charge generation materials such as phthalocyanines and metallophthalocyanines are also capable of transporting positive charge carriers in addition to their photo-induced charge generation capabilities. The inability for the charge generation materials to transport negative charge carriers can give rise to an undesirable increase in the residual potential of the photoreceptors consisting of more than one charge generation layer. Judicious selections of conductive materials that are capable of transporting negative charge carriers can effectively reduce the undesirable accumulation of residual potential in the intermittent charge generation layer utilized in the present invention. In the formulations disclosed in the present invention, electrically conductive metal oxide powder can be used as additives in the underlying charge generation layer, CGL1, to avoid accumulation of negative charge after exposure to light, so as to minimize residual potential. However, the use of the electrically conductive powder can be avoided by using appropriate charge generation materials which also exhibit satisfactory charge transporting characteristics.

BRIEF DESCRIPTION OF THE DRAWINGS

The present invention will be described in detail with reference to the drawings showing the preferred embodiments of the present invention, wherein.

DETAILED DESCRIPTION OF THE PREFERRED EMBODIMENTS

The present invention discloses a new configuration of electrophotographic photoreceptors which allow the photoreceptors to exhibit greatly enhanced photosensitivity. In the configuration disclosed in the present invention, the charge generation member, which would comprise only a single charge generation layer in the conventional configurations, is made to comprise a plurality of charge generating layers. The multi-layered charge generation member is then combined with a charge transporting layer to complete the fabrication of the photoreceptors of the present invention.

Figure 1A:
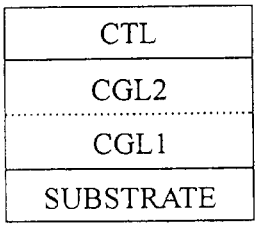
FIG. 1 shows the configuration of the electrophotographic photoreceptors comprising multiple charge generation layers.
Figure 1B:
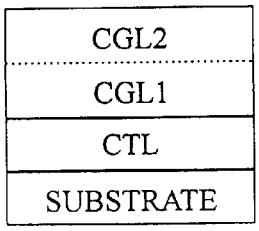
Figure 1C:
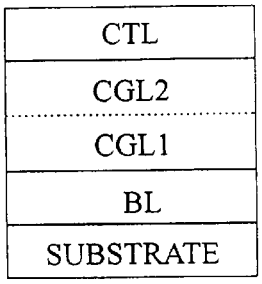
Figure 1D:
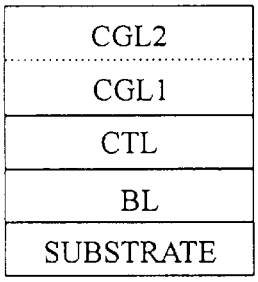
Figure 1E:
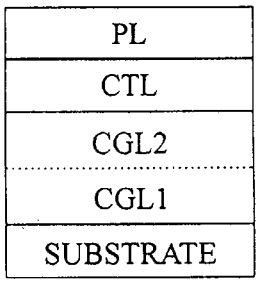
Figure 1F:
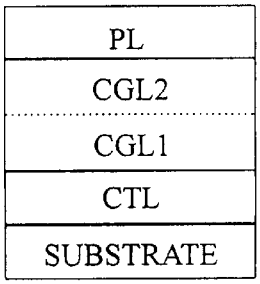
Figure 1G:
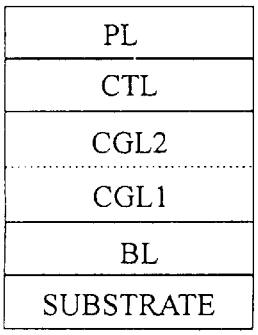
Figure 1H:
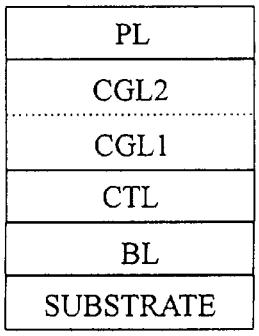
Figure 1I:
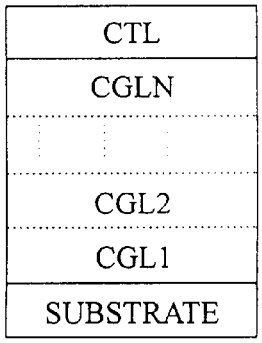
Fig. 1(I) (PRIOR ART)
Figure 2:
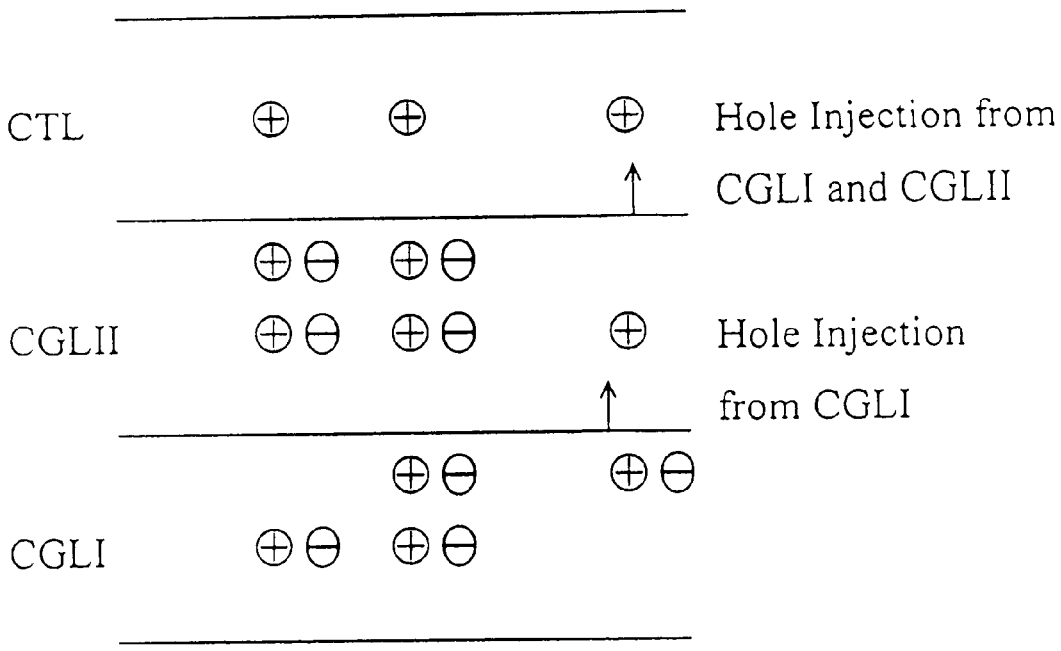
FIG. 2 shows the schematic representation of charge generation and charge transport in the dual charge generation layers.

Other non-photosensitive layers such as intermediate subbing layer, charge blocking layer and protective layer can be optionally applied to reinforce the adhesion and the abrasion-resistant characteristics of the photoreceptors. These configurational formats are described as schematic representations shown in FIGS. 1(A) through 1(H). In one embodiment of the charge generation member disclosed in the present invention, two charge generation layers, designed as CGL1 and CGL2 (FIG. 1), are formed consecutively; these two layers can vary in their film thickness and the concentration of charge generation materials to achieve an optimal photosensitivity. The selection of the charge generation material in CGL1 and CGL2 is an important factor to accomplish the desirable photosensitivity enhancement. The main criterion is that the ionization potential of the charge generation material in CGL2 should be equal to or lower than that of the charge generation material in CGL1, so that positive charge carriers at the interface of CGL1 and CGL2 can further be transported into CGL2 under a thermodynamically favorable condition for charge transition. By the same token, the configuration of the electrophotographic photoreceptors disclosed in the present invention can be extended to include more than two charge generation layers as depicted in FIG. 1(I).

In summary, in order to allow the photo-generated charges to transport through the stacked charge generation layers of the present invention the following relation must be satisfied:

$$(\mathrm{IP})_{CGL}1 \geqq (\mathrm{IP})_{CGL2}$$

where $(\mathrm{IP})_{CGLI}$ and $(\mathrm{IP})_{CGLII}$ are the ionization potentials of the charge generation material in the first and the second charge generation layers, respectively. The photogenerated charge in CGLI appeared to be transported through CGLII and combined with the photogenerated charge in CGLII to inject into the charge transport layer. Similarly, a modified configuration consisting of more than two charge generation layers can be implemented according to the following potential characteristics to boost charge generation efficiency:

$$(\mathrm{IP})_{CGL1} \geqq (\mathrm{IP})_{CGL2} \geqq (\mathrm{IP})_{CGL3} \cdots \geqq (\mathrm{IP})_{CGLn}$$

CGL1 is the charge generation layer closest to the substrate and CGLn is the charge generation layer furthest from the substrate.

It should be noted that in FIGS. 1(A) through 1(H), the interface between the charge generation layers is shown as a dotted line. This designation has a significant indication in that, although the above discussions describe each charge generation layer as a separate "layer", in order to prevent the shortcomings associated with a true interface, it is highly preferred that the charge generation materials used in the neighboring charge generation "layers" are of the same, or at least very similar chemical structure, so that the interface between the neighboring charge generation layers will not be as distinct as the conventional interfaces that exist between two different materials. In other words, each charge generation layer in the present invention should not be considered as a separate layer. Rather, each should be considered as a "sub-layer" within the overall charge generation layer (which was termed the charge generation member to distinguished from the conventional single-layer-structured charge generation layer). In a preferred embodiment of the present invention, the charge generation materials in the adjacent sub-layers have the same chemical structure but different crystalline structure.

By using same or at least very similar charge generation chemicals for the constituent charge generation layers (or actually charge generation sub-layers) in the bulk charge generation layer (or a multi-layered charge generation member), a concentration polarization of charge generation molecules can be promoted (which, as shown in the present invention, improved the photosensitivity of the photoreceptor), without actually forming the conventional multi-layer structure, thus avoiding the problems, such as high dark decay, etc., observed with the conventional interfaces.

In a preferred embodiment of the present invention, β-form titanyl phthalocyanine (TiOPc) was used in CGL 1, and an ammonia-modified titanyl phthalocyanine was used in all other sub-layers CGLi, where i>1; charge generation material. The coating solution of CGL1 was prepared by thoroughly mixing and milling the β-TiOPc and the polymer binder in the presence of methanol and n-butanol in a sand mill device or a paint shaker. Before mixing with the polymer binder, β-TiOPc was ground by glass beads in the milling device in the presence of n-butanol for a time period of at least 3 hrs. The solution of the polymer binder was prepared separately by dissolving the polymer in methanol and n-butanol. To the ground and well-mixed β-TiOPc in butanol, the polymer solution was then added and the mixture was subject to vigorous shaking and grinding by virtue of the glass beads in the milling device. After a processing time of 1~5 days and preferably 2~3 days, a well-mixed solution of charge generation material and polymer binder was obtained and its compositions were specified for the coating of the CGL1 layer. The main requirement for the implementation of the present invention is that the adjacent sub-layers have similar chemical structure, thus, all the charge generation sub-layers can contain the same charge generation material which is ammonia-modified titanyl phthalocyanine.

Another embodiment of the present invention involved the addition of an electrically conductive powder to the aforementioned solution of charge generation material and polymer binder. The milling and mixing also last for 1~5 days. The charge generation material and the electrically conductive powder were mixed at a ratio ranging from 10:1 to 1:10 by weight, preferably from 5:1 to 1:5 by weight. The corresponding ratio of the charge generation material to the polymer binder varied from 1:100 to 1:5 by weight, preferably from 1:50 to 1:5 by weight. These ranges of weight ratio were found to result in the optimal photosensitivity as well as the minimal dark decay and reduced residual potential for the prepared photoreceptors.

The charge generation material in CGL 1 was found to exhibit the capability to augment the overall charge generation efficiency for the photoreceptor. On the other hand, the charge generation material in CGL2, titanyl phthalocyanine, was found not only to generate charge carriers owing to its own charge generation ability, but also to transport the charge carriers injected from CGL1. And these two sources of charge carriers add up to improve the efficiency of the prepared photoreceptor. A very high hole drift mobility in the range of from $1.2\times10^{-6}$ to $7\times10^{-5}$ $cm^2V^{-1}sec^{-1}$ was reported in the literature for titanyl phthalocyanine. Preferably, the charge generation material should have a hole drift mobility of at least $1.0\times10^{-6}cm^2V^{-1}sec^{-1}$ A resin having a random copolyamide backbone structure was selected as the polymer binder for CGL1. This polymer binder was made by Daicel-Hüls, Ltd., having a tradename of Daiamid. Due to the presence of polar amide linkages, this alcohol-soluble polymer binder was found to provide a closely associated interaction with both the charge generation material and the electrically conductive powder. Other resins were also found suitable for the preparation of CGL1; these resins include Elvamide 8061, Elvamide 8064 and Elvamide 8023 (E. I. Dupont Nemours), CM8000 (Toray), and poly(vinyl butyral). The electrically conductive powder used in CGLI was provided by Ishihara Sangyo Kaisha, Ltd. (ET-500W) which was a titanium oxide powder which has been grain-shaped, antimony-doped and whose particle size was in the range of from 0.2 to 0.3 μm. The addition of the conductive powder was found to improve the characteristics of electric grounding thus resulting in reduced residual potential for the photoreceptor so prepared. However, it only has passive benefit in terms of photosensitivity and does not affect the main function of the multiple charge generation layers which is aimed at enhancing the photosensitivity of the photoreceptors.

Other embodiments of the present invention employed several other forms of titanyl phthalocyanine, such as α-TiOPc and amorphous TiOPc, and copper phthalocyanine (CuPc) was used as the charge generation material in CGL1. Substantially enhanced photosensitivity was also observed in these photoreceptors containing a dual-or multiple-layer charge generation member. In these embodiments, the charge generation material was first subject to vigorous grinding in n-butanol to result in a homogeneous suspension of fine particles of particle size smaller than 0.3 μm. The amount of the charge generation material to n-butanol can be varied from 1:2 to 1:50 by weight, preferably from 1:5 to 1:20 by weight, to achieve efficient contact between the charge generation material and the glass beads, as well as to maintain good homogeneity during grinding. The polymer solution containing the alcohol-soluble copolyamide and optionally the electrically conductive powder, were then added and the resulting mixture was diluted with methanol and n-butanol. The solid content can be varied from 10 to 40% by weight and preferably from 15 to 25% by weight. A processing time of from 1 to 5 days, preferably from 2 to 3 days, was proceeded to obtain the well-mixed solution for the coating of CGL1.

For the preparation of photoreceptors, a layered configuration comprising a blocking layer (BL) or a subbing layer or an intermediate layer, multiple charge generation layers (CGL1 and CGL2 etc.), a charge transporting layer (CTL), and a protective layer, was constructed. Each layer has its respective function to contribute to the overall properties and performance of the photoreceptors. The incorporation of the blocking layer or subbing layer or intermediate layer is optional and its presence does not affect the main function of photo-induced charge generation in the photoreceptor. Suitable materials for use as the blocking layer are those with hole blocking and electron transporting capabilities. Also, suitable blocking-layer materials must be able to provide good adhesion to both the metal surface (conductive substrate) and the overlaying organic film (charge generation layer). Commonly used blocking-layer materials include polyamides, polyesters, poly(methyl methacrylate), poly(vinyl chloride), poly(vinyl alcohol), poly(vinyl acetate), poly(acrylic acid), phenolic resin, etc. One or more polymer resins are dissolved in a suitable organic solvent to form a coating solution to form a blocking layer with a thickness ranging from 0.1 μm to 10 μm, preferably from 0.5 to 2 μm. In some applications, conductive particles of submicron size can also be incorporated in the subbing layer for the special treatment of the conductive substrate to prevent undesirable reflection of light from the substrate.

The first charge generation layer (CGL1) was prepared by coating the charge generation solution containing the charge generation material, polymer binder and, optionally, conductive particle as described previously. Appropriate film thickness of CGL1 ranged from 0.5 to 10 μm, preferably from 2 to 5 μm, to result in the desired enhancement of photosensitivity.

The second charge generation layer (CGL2) was prepared by coating a second charge generation solution containing ammonia-modified titanyl phthalocyanine (TiOPc) dissolved in cyclohexanone and methy ethyl ketone. The ammonia-modified TiOPc was obtained by treating TiOPc with a series of processing methods including ball milling, wet milling in the presence of chloro-containing organic solvents and ammonia gas, and filtration and drying. In preparing the coating solution, the ammonia-modified TiOPc was milled with cyclohexanone followed by adding methyl ethyl ketone, cyclohexanone and poly(vinyl butyral) and continuous milling to result in the homogeneous solution. Other known materials may be used for forming the polymer binder in the charge generation layer of CGL2. Suitable examples include polystyrene, poly(vinyl acetate), poly(vinyl butyral), poly(vinyl chloride), poly(methyl methacrylate), polyester, polycarbonate(bisphenol A type or Z type), phenol-formaldehyde resins, and silicone resins. The ratio of charge generation components to polymer binder is usually set in a range of from 1:10 to 10:1 by weight, preferably from 1:2 to 2:1 by weight. The thickness of CGL2 may be varied in a range of from 0.01 to 5 $\mu$m, preferably from 0.05 to 2 $\mu$m. Charge generation layers CGL1 and CGL2 collectively form the multi-layer charge generation member of the present invention with an interface therebetween.

Charge transport layers are usually made of a polymer binder and an electroactive component, which comprises a charge transporting material. The polymer binder is the material responsible for providing wear resistance of the photoreceptors so prepared. Compatibility between polymer binder and charge transporting material is important with regard to thermodynamic phase stability of the final solid mixture. In addition, generally speaking, high polarity is required for the polymer binder to be an adequate matrix through which the charge transporting material can transport charge efficiently. Commonly used polymer binder materials for preparing the charge transporting layer include polycarbonates such as bisphenol A type or Z type resins, polystyrene, polysulfone, acrylic resins, and acrylonitrile-styrene copolymers. Commercially available charge transporting materials usually provide charge carrier drift mobility in a range of from $10^{-6}$ to $10^{-4}$ $cm^2V^{-1}sec^{-1}$. Examples of such materials include aromatic tertiary amino compounds, hydrazone derivatives, oxadiazole derivatives, quinazoline derivatives, fluorenone compounds etc. In the present invention, a hydrazone compound as shown in the following structural representation (formula 1) was used as the charge transport material.

(Formula I)

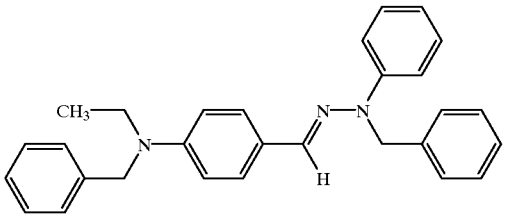

This hydrazone compound was molecularly distributed in a polymer matrix (polycarbonate Z type, PCZ) to form the charge transporting layer of the photoreceptors. In preparing the coating solutions, hydrazone and PCZ were codissolved in toluene. The weight ratio of hydrazone to PCZ was kept in a range of from 3:5 to 1:1. A higher hydrazone content was found to result in a more efficient charge transport, but at the expense of less thermodynamic phase stability of the solid mixture. Total solid contents including both hydrazone and polycarbonate were maintained between 15% and 25% by weight with respect to the total weight of the solution. The thickness so obtained ranged from 15 to 40 $\mu$m and preferably from 20 to 30 $\mu$m.

An additional overlying layer providing further wear resistance can be optionally applied on top of the photosensitive layers. It is important that the electric resistance of this additional protective layer is in the range of from $10^9$ to $10^{12}$ Ω/¤ so that charge carriers can be transported through the protective layer and, in the meantime, the potential attenuation in the dark can still be minimized. Examples of suitable materials for providing the protective layers include cross-linkable resins incorporating fine powders of conductive metal oxide, flexible resins containing charge transporting material and an antioxidant compound, silicon- and fluoro-containing particles imbedded in flexible resins, etc.

The present invention will now be described more specifically with reference to the following examples. It is to be noted that the following descriptions of examples, including the preferred embodiment of this invention, are presented herein for purposes of illustration and description, and are not intended to be exhaustive or to limit the invention to the precise form disclosed.

Preparation of Materials:

Ammonia-Modified TiOPc: The procedures for preparing ammonia-modified titanyl phthalocyanine (TiOPc) were disclosed in U.S. Pat. No. 5,567,559, and the content thereof is incorporated herein by reference. Ball milling was performed on TiOPc to obtain amorphous TiOPc by vigorous grinding of the material. The amorphous TiOPc was then dispersed in chlorobenzene and stirred vigorously while ammonia gas was introduced to the dispersed solution. After a processing time of 10 hrs, TiOPc was filtered and dried to afford the ammonia-modified TiOPc.

β-Form TiOPc: TiOPc was ground in a ball mill device for 3 to 7 days to obtain amorphous TiOPc. The amorphous TiOPc was then subject to vigorous grinding in presence of chlorobenzene in a paint shaker for 10 hrs, resulting in the β-form TiOPc.

α-Form TiOPc: The amorphous TiOPc was subject to vigorous grinding in presence of tetrahydrofuran in a paint shaker for 10 hrs, resulting in the α-form TiOPc.

Measurements of Photoelectric Properties:

The photoelectric measurement was performed on a QEA PDT-2000 drum scanner. First, the photoreceptor was electrostatically charged with a corona discharge with an applied voltage of 6.5 kV which led to an initial surface potential, $V_0$, of around −700 volts. The charging-exposure-erasure cycles were proceeded repeatedly for 8 cycles and an average value of $V_0$ was obtained to represent the charge acceptance of the photoreceptor. After resting for 2 seconds in the dark, the charged member reached a surface potential, $V_{ddp}$, which is called the dark development potential, and the dark decay is defined as the difference between $V_0$ and $V_{ddp}$. In measuring the photoelectric response, the photoreceptor was exposed to a filtered light (at 780 nm) radiated from a halogen lamp. The exposure of light was continued until after an exposure energy (cumulative) of 1.0 $\mu J/cm^2$ was reached, and the corresponding surface potential, defined as the residual potential, $V_r$, was recorded. Half exposure energy, $E_{1/2}(\mu J/cm^2)$, was determined by finding the amount of energy needed to reduce the surface potential to half of its initial value ($V_0$/ 2). Half exposure energy is an important parameter indicating the photosensitivity of the photoreceptor. A lower $E_{1/2}$ value indicates a higher photosensitivity.

EXAMPLE 1

150 g of copolyamide (DAIMID, Daicel-Hülls) was dissolved in 430 g of methanol to prepare the solution 1. 0.25 g of β-form TiOPc and 43 g of n-butanol were mixed in a paint shaker device and subject to vigorous grinding for 48 hrs and then, to the well ground TiOPc solution was added 58 g of solution 1 and 11 g of methylene chloride and vigorous grinding was continued for another 16 hrs to result in the coating solution for CGL1. Dip coating was performed to obtain CGL1 with a thickness of about 5 μm on a cylindrical aluminum substrate.

Coating solution of CGL2 was prepared by mixing 1.5 g of ammonia-modified TiOPc and 38 g of cyclohexanone in a paint shaker and the mixture was subject to vigorous grinding for 4 hrs. To the mixture was added 1.5 g of poly(vinyl butyral) and 38 g of methyl ethyl ketone and vigorous grinding was continued for 48 hrs to result in the coating solution. A CGL2 layer with a thickness of about 0.5 μm was prepared by dip coating of the solution on the previously formed CGL1.

Charge transporting layer (CTL) was obtained by coating of the toluene solution of charge transporting material, hydrazone, and Z-type polycarbonate. The thickness of CTL was about 25 μm.

EXAMPLE 2

The preparations of multiple layers of CGL1, CGL2, and CTL including the compositions and thickness were the same as those of EXAMPLE 1 except that an electrically conductive solid powder was added in CGL1. This was done by adding 5 g of titanium oxide (trade name ET500W, I.S.K.) to the mixture of 0.25 g of β-form TiOPc, 11 g of methylene chloride, and 58 g of polymer solution 1. The resulting mixture was subject to vigorous grinding for 16 hrs to complete the preparation of solution for coating of CGL1.

EXAMPLE 3

The preparations of multiple layers of CGL1, CGL2, and CTL including the compositions and thickness were the same as those of EXAMPLE 2 except that the content of β-form TiOPc in CGLI was increased. The amount of β-form TiOPc in preparing the solution for coating of CGL1 was increased from 0.25 g to 0.5 g.

EXAMPLE 4

The preparations of multiple layers of CGL1, CGL2, and CTL including the compositions and thickness were the same as those of EXAMPLE 2 except that the content of β-form TiOPc in CGL1 was increased. The amount of β-form TiOPc in preparing the solution for coating of CGL1 was increased from 0.25 g to 1.0 g.

EXAMPLE 5

The preparations of multiple layers of CGL1, CGL2, and CTL including the compositions and thickness were the same as those of EXAMPLE 2 except that the content of β-form TiOPc in CGL1 was increased. The amount of β-form TiOPc in preparing the solution for coating of CGL1 was increased from 0.25 g to 1.5 g.

EXAMPLE 6

The preparations of multiple layers of CGL1, CGL2, and CTL including the compositions and thickness were the same as those of EXAMPLE 2 except that the content of β-form TiOPc in CGL1 was increased. The amount of β-form TiOPc in preparing the solution for coating of CGL1 was increased from 0.25 g to 2.0 g.

COMPARATIVE EXAMPLE 1

This example was prepared to compare the effectiveness of the present invention and the conventional formulation of electrophotographic photoreceptors in which only one charge generation layer was used. In absence of CGL1, a CGL layer containing the composition specified as that in EXAMPLE 1 was coated on an aluminum substrate and its thickness was prepared as about 5.0 μm. The composition and thickness of CTL were identical to that of EXAMPLE 1.

COMPARATIVE EXAMPLE 2

This example was also prepared to compare the effectiveness of the present invention and the conventional formulation of electrophotographic photoreceptors in which only one charge generation layer was used. In absence of CGL1, a CGL layer containing the composition specified as that in EXAMPLE 1 was coated on an aluminum substrate and its thickness was prepared as about 0.5 μm. The composition and thickness of CTL were identical to that of EXAMPLE 1.

EXAMPLE 7

The preparations of multiple layers of CGL1, CGL2, and CTL including the compositions and thickness were the same as those of EXAMPLE 2 except that α-form TiOPc was used in place of β-form TiOPc in preparation of CGL1. The amount of α-form TiOPc in preparing the solution for coating of CGL1 was also 0.25 g.

EXAMPLE 8

The preparations of multiple layers of CGL1, CGL2, and CTL including the compositions and thickness were the same as those of EXAMPLE 2 except that CuPc was used in place of β-form TiOPc in preparation of CGL1. The amount of CuPc in preparing the solution for coating of CGL1 was also 0.25 g.

Table 1 lists the photoelectric data of the photoreceptors for the aforementioned examples and comparative examples. Comparisons of the photoelectric data of the photoreceptors containing CGL1 (EXAMPLE 1 through 8) and those with only one CGL (COMPARATIVE EXAMPLE 1 and 2) show that the interface created by adding an additional charge generation layer can indeed substantially enhance the photosensitivity. For example, comparisons of EXAMPLE 1 and COMPARATIVE EXAMPLE 1 show the photosensitivity is significantly increased with the corresponding $E_{1/2}$ value reduced from 0.35 μJ/cm$^2$ to 0.21 μJ/cm$^2$.

TABLE 1

Photoelectric data measured by photo-induced discharge curve (PIDC).

| | Charge Acceptance (volts) | Dark decay ($V_{dd}$, volts) | Initial potential ($V_o$, volts) | Half-Exposure Energy ($E_{1/2}$, μm/cm$^2$) | Residual Potential (Vr, volts) |
|---|---|---|---|---|---|
| Example 1 | 690 ± 5 | 17 | 690 | 0.21 | 105 |
| Example 2 | 695 ± 5 | 19 | 697 | 0.22 | 106 |
| Example 3 | 697 ± 3 | 21 | 696 | 0.21 | 97 |
| Example 4 | 696 ± 5 | 18 | 703 | 0.23 | 99 |
| Example 5 | 706 ± 4 | 19 | 706 | 0.23 | 111 |
| Example 6 | 709 ± 5 | 17 | 704 | 0.23 | 119 |
| Comp. Ex. 1 | 625 ± 9 | 107 | 601 | 0.35 | 257 |
| Comp. Ex. 2 | 655 ± 7 | 49 | 651 | 0.27 | 129 |
| Example 7 | 698 ± 3 | 20 | 699 | 0.22 | 101 |
| Example 8 | 704 ± 4 | 17 | 705 | 0.21 | 98 |
| Example 9 | 690 ± 5 | 25 | 685 | 0.13 | 80 |

EXAMPLE 9

The photoreceptor in this example consists of four charge generation layers. The ammonia-modified TiOPc was used in all four charge generation layers. Each of the four layers was prepared by the same procedure as that of CGL2 described in EXAMPLE 1. The coating solution was coated after the previously coated layer was dried and the consecutively formed four layers accumulated a total thickness of ~3.0 $\mu$m. A charge transporting layer containing the same composition and thickness as the previously described examples was finally coated to result in the photoreceptor consisting of four charge generation layers. The photosensitivity, shown in Table 1, was significantly enhanced to exhibit an $E_{1/2}$ value of 0.13 $\mu$m/cm$^2$ and, in the meantime, also retain minimal dark decay ($V_{dd}$=25 volts) and residual potential ($V_r$=80 volts). A comparison of the results obtained from Example 9 and Comp. Ex. 1 indicates that by creating three interfaces (i.e., using four charge generating layers) in the charge generating member, result in almost three-fold increase in the photosensitivity, measured based on the inverse of $E_{1/2}$.

What is claimed is:

1. A photoreceptor for use in electrophotographic applications comprising:

(a) an electrically conductive substrate;

(b) a charge generation layer; and (c) a charge transport layer;

(d) wherein said charge generation layer comprises a plurality of contiguous charge generation sub-layers, and all of said charge generation sub-layers contain charge generation materials having the same or at least very similar chemical structure such that there is no distinct interface between any two adjacent sub-layers.

2. The photoreceptor for use in electrophotographic applications according to claim 1 wherein said plurality of charge generation sub-layers contain respective charge generation materials which satisfy the following relationship:

$$(IP)_{CGL1} \geqq (IP)_{CGL2} \geqq (IP)_{CGL3} \cdots (IP)_{CGLn}$$

wherein:

(a) $(IP)_{CGLi}$, i=1, 2, . . . , n, represents an ionization potential of said charge generation material in charge generation sub-layer CGLi; and (b) a lower value of i indicating closer proximity to said substrate, and a greater value i indicates further away from said substrate.

3. The photoreceptor for use in electrophotographic applications according to claim 1 wherein each of said charge generation sub-layer in said charge generation layer contains a charge generation material with a hole drift mobility of at least $1.0\times10^{-6}$ cm$^2$V$^{-1}$sec$^{-1}$.

4. The photoreceptor for use in electrophotographic applications according to claim 3 wherein said charge generation material is titanyl phthalocyanine.

5. The photoreceptor for use in electrophotographic applications according to claim 4 wherein said charge generation material in said CGL1 sub-layer is α- or β-form of titanyl phthalocyanine, and said charge generation material in said CGLi sub-layer, i>1, is ammonia-modified titanyl phthalocyanine.

6. The photoreceptor for use in electrophotographic applications according to claim 1 wherein all of said charge generation sub-layers contain charge generation materials having the same chemical structure.

7. The photoreceptor for use in electrophotographic applications according to claim 6 wherein said charge generation materials have the same chemical structure but different crystalline structure.

8. The photoreceptor for use in electrophotographic applications according to claim 1 wherein said all said charge generation sub-layers contain the same charge generation material which is ammonia-modified titanyl phthalocyanine.

9. The photoreceptor for use in electrophotographic applications according to claim 1 wherein said charge generation layer closest to said substrate has a highest thickness relative to all other charge generation layers.

10. The photoreceptor for use in electrophotographic applications according to claim 1 wherein each of said charge generation sub-layer in said charge generation layer comprises a charge generation material and a polymer binder selected from the group consisting of poly(vinyl butyral), polystyrene, poly(vinyl acetate), poly(vinyl chloride), poly(methyl methacrylate), polyester, polycarbonate(bisphenol A type or Z type), phenol-formaldehyde resins, and silicone resins.

11. The photoreceptor for use in electrophotographic applications according to claim 1 wherein said charge generation sub-layer closest to said substrate comprises a charge generation material and a polymer binder having a random copolyamide backbone structure.

12. The photoreceptor for use in electrophotographic applications according to claim 11 wherein said charge generation sub-layer closest to said substrate further comprises an electrically conductive power.

13. The photoreceptor for use in electrophotographic applications according to claim 1 wherein said charge generation layer comprises more than two said charge generation sub-layers.

14. The photoreceptor for use in electrophotographic applications according to claim 1 which further comprises a protective layer or a blocking layer, or both.

15. The photoreceptor for use in electrophotographic applications according to claim 1 wherein said charge generation layer is disposed on top of said charge transport layer.

16. The photoreceptor for use in electrophotographic applications according to claim 1 wherein said charge transport layer is disposed on top of said charge generation layer.

17. A method for preparing a photoreceptor for use in electrophotographic applications comprising the steps of:

(a) forming a combination of a multi-layered charge generation layer and a charge transportation layer on an electrically conductive substrate;

(b) wherein said multi-layered charge generation layer is formed by sequentially forming a plurality of charge generation sub-layers first on said substrate, or on said charge transport layer if said charge transport layer was already formed on said substrate, then on said charge generation sub-layer that was already formed, so as to create an interface between adjacent said charge generation sub-layers (c) further wherein all of said charge generation sub-layers contain charge generation materials having the same or at least very similar chemical structure such that there is no distinct interface between any two adjacent sub-layers.

18. The method for preparing photoreceptor for use in electrophotographic applications according to claim 17 wherein said plurality of charge generation sub-layers contain respective charge generation materials which satisfy the following relationship:

$$(IP)_{CGL1} \geqq (IP)_{CGL2} \geqq (IP)_{CGL3} \cdots (IP)_{CGLn}$$

wherein:

(a) $(IP)_{CGLi}$, i=1, 2, . . . , n, represents an ionization potential of said charge generation material in charge generation sub-layer CGLi; and (b) a lower value of i indicating closer proximity to said substrate, and a greater value i indicates further away from said substrate.

19. The method for preparing photoreceptor for use in electrophotographic applications according to claim 17 wherein each of said charge generation sub-layer in said charge generation layer contains a charge generation material with a hole drift mobility of at least $1.0\times10^{-6}$ $cm^2V^{-1}sec^{-1}$.

20. The method for preparing photoreceptor for use in electrophotographic applications according to claim 19 wherein said charge generation material is titanyl phthalocyanine.

21. The photoreceptor for use in electrophotographic applications according to claim 20 wherein said charge generation material in said CGL1 sub-layer is α-or β-form of titanyl phthalocyanine, and said charge generation material in said CGLi sub-layer, i>1, is ammonia-modified titanyl phthalocyanine.

22. The method for preparing photoreceptor for use in electrophotographic applications according to claim 17 wherein all of said charge generation sub-layers contain charge generation materials have the same chemical structure.

23. The method for preparing photoreceptor for use in electrophotographic applications according to claim 22 wherein said charge generation materials have the same chemical structure but different crystalline structure.

24. The method for preparing photoreceptor for use in electrophotographic applications according to claim 17 wherein said all said charge generation sub-layers contain the same charge generation material which is ammonia-modified titanyl phthalocyanine.

25. The method for preparing photoreceptor for use in electrophotographic applications according to claim 17 wherein said charge generation layer closest to said substrate has a highest thickness relative to all other charge generation layers.

26. The method for preparing photoreceptor for use in electrophotographic applications according to claim 17 wherein each of said charge generation sub-layer in said charge generation layer comprises a charge generation material and a polymer binder selected from the group consisting of poly(vinyl butyral), polystyrene, poly(vinyl acetate), poly (vinyl chloride), poly(methyl methacrylate), polyester, polycarbonate(bisphenol A type or Z type), phenol-formaldehyde resins, and silicone resins.

27. The method for preparing photoreceptor for use in electrophotographic applications according to claim 17 wherein said charge generation sub-layer closest to said substrate comprises a charge generation material and a polymer binder having a random copolyamide backbone structure.

28. The method for preparing photoreceptor for use in electrophotographic applications according to claim 27 wherein said charge generation sub-layer closest to said substrate further comprises an electrically conductive power.

29. The method for preparing photoreceptor for use in electrophotographic applications according to claim 17 wherein said charge generation layer comprises more than two said charge generation sub-layers.

30. The method for preparing photoreceptor for use in electrophotographic applications according to claim 17 which further comprises the step of forming a blocking layer on top of said substrate before forming said charge generation layer or said charge transportation layer, or forming a protective layer on top of said charge generation layer or said charge transportation layer, or both.

31. The method for preparing photoreceptor for use in electrophotographic applications according to claim 17 wherein said charge generation layer or said charge transportation layer wherein said charge generation layer is disposed on top of said charge transport layer.

32. The method for preparing photoreceptor for use in electrophotographic applications according to claim 17 wherein said charge generation layer or said charge transportation layer wherein said charge transport layer is disposed on top of said charge generation layer.

* * * * *